US008789979B2

(12) United States Patent
Wu

(10) Patent No.: US 8,789,979 B2
(45) Date of Patent: Jul. 29, 2014

(54) ILLUMINATING DEVICE

(71) Applicants: Cal-Comp Electronics & Communications Company Limited, New Taipei (TW); Kinpo Electronics, Inc., New Taipei (TW)

(72) Inventor: Hsien-Chang Wu, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 65 days.

(21) Appl. No.: 13/736,973

(22) Filed: Jan. 9, 2013

(65) Prior Publication Data

US 2013/0134856 A1 May 30, 2013

Related U.S. Application Data

(63) Continuation-in-part of application No. 13/327,783, filed on Dec. 16, 2011.

(51) Int. Cl.
*H05B 33/02* (2006.01)
*F21V 29/00* (2006.01)

(52) U.S. Cl.
CPC ..... *H05B 33/02* (2013.01); *F21V 29/22* (2013.01)
USPC ..... 362/294; 313/46; 313/312

(58) Field of Classification Search
CPC ..... H05B 33/02; F21V 29/22
USPC ..... 362/294; 313/46, 312
See application file for complete search history.

(56) References Cited

U.S. PATENT DOCUMENTS

| | | | | |
|---|---|---|---|---|
| 6,794,801 | B2 * | 9/2004 | Yasuda et al. | 313/46 |
| 2003/0080691 | A1 | 5/2003 | Yasuda et al. | |
| 2009/0189169 | A1 | 7/2009 | Wei | |
| 2011/0050124 | A1 * | 3/2011 | Bailey et al. | 315/294 |

OTHER PUBLICATIONS

"Office Action of U.S. Appl. No. 13/327,783" issued on Aug. 15, 2013, p. 1-p. 12.

* cited by examiner

*Primary Examiner* — Anabel Ton
(74) *Attorney, Agent, or Firm* — Jianq Chyun IP Office

(57) ABSTRACT

An illuminating device including a hollow body and a circuit board is provided. The hollow body includes a first opening end, a second opening end and a pair of first hooking portions, wherein a bore of the second opening end is larger than a bore of the first opening end. The first hooking portions are disposed on the first opening end. The circuit board is disposed in the hollow body and has a pair of second hooking portions, wherein the first hooking portions interfere with the second hooking portions.

12 Claims, 5 Drawing Sheets

ILLUMINATING DEVICE

CROSS-REFERENCE TO RELATED APPLICATION

This application is a continuation-in-part application of and claims the priority benefit of U.S. application Ser. No. 13/327,783, filed on Dec. 16, 2011, now pending. The U.S. application Ser. No. 13/327,783 claims the priority benefit of China application serial no. 201110386852.5, filed on Nov. 29, 2011. This application also claims the priority benefit of Taiwan application serial no. 101117448 filed on May 16, 2012. The entirety of each of the above-mentioned patent applications is hereby incorporated by reference herein and made a part of this specification.

BACKGROUND OF THE INVENTION

1. Field of the Invention

The present invention relates to an illuminating device, and more particularly, to an illuminating device having a structure different from that of conventional illuminating devices.

2. Description of Related Art

In recent years, people have made effort to develop new types of lighting sources. Light emitting diode (LED) has advantages of power saving, durable, and small size, which are hardly comparable with traditional lighting sources (such as incandescent lamp and fluorescent lamp). Hence, light emitting diode is generally acknowledged as the most valuable "green" lighting source in the new century, and could become a leading product in the lighting market by replacing incandescent lamp and fluorescent lamp.

Specifically, light emitting diode belongs to semiconductor devices, and is mainly made of compounds of group III-V elements, such as gallium phosphide (GaP) or gallium arsenide (GaAs). Light emitting diode is to release superfluous energy in a light with a specific wavelength range by applying a current to a compound semiconductor and combining electrons with electron holes. Since luminescence of light emitting diode is not through heating or discharging, light emitting diode has a life span of 100000 hours or more, and better photoelectric conversion efficiency than traditional lighting sources.

FIG. 1 is a partial three-dimensional schematic view of a conventional illuminating device which uses a light emitting diode as its light source, and FIG. 2 is a cross-sectional schematic view along a section line A-A in FIG. 1. Referring to both FIG. 1 and FIG. 2, in a conventional illuminating device 100 which uses a light emitting diode as its light source, the position of a circuit board 120 disposed in a hollow body 110 of the illuminating device 100 is limited by a pair of hooking portions 112 disposed on a side wall of the hollow body 110, wherein the hooking portions 112 are located on an opening end 110*a* of the hollow body 110 relatively near a heat sink (not illustrated). From FIG. 1 and FIG. 2, it can be seen that the hollow body 110 and the circuit board 120 have necked-down portions 114 and 122, respectively. Therefore, when the circuit board 120 is inserted into the hollow body 110 from the opening end 110*a* with a larger bore, the necked-down portion 122 of the circuit board 120 is supported by the necked-down portion 114 of the hollow body 110, and then by the hooking portions 112 leaning against the circuit board 120, the circuit board 120 would be confined in the hollow body 110.

However, under such disposition structure, due to limitation on the position of the hooking portions 112, the size of the circuit board 120 cannot be increased effectively. In addition, as the hooking portions 112 are located on the opening end 110*a* of the hollow body 110 relatively near a heat sink (not illustrated), and the hooking portions 112 are formed by hollowing out a portion of a side wall of the hollow body 110, when a thermal compound (not illustrated) is filled into the hollow body 110, the thermal compound (not illustrated) can easily leak from a hollowed-out portion 116.

SUMMARY OF THE INVENTION

The present invention provides an illuminating device, which has a structure different from that of conventional illuminating devices.

The present invention proposes an illuminating device comprising a hollow body and a circuit board, wherein the hollow body has a first opening end, a second opening end and a pair of first hooking portions, wherein a bore of the second opening end is larger than a bore of the first opening end, and the first hooking portions are disposed on the first opening end. The circuit board is disposed in the hollow body and has a pair of second hooking portions. The first hooking portions interfere with the second hooking portions.

In an embodiment of the illuminating device of the present invention, the first opening end is a threaded portion.

In an embodiment of the illuminating device of the present invention, the first hooking portions are located at two ends of a diameter of the first opening end.

In an embodiment of the illuminating device of the present invention, hooking directions of the first hooking portions are toward the circuit board.

In an embodiment of the illuminating device of the present invention, the second hooking portions are located outside the hollow body, with their hooking directions being toward the hollow body.

In an embodiment of the illuminating device of the present invention, the first hooking portions are formed by hollowing out a portion of a side wall of the hollow body.

In an embodiment of the illuminating device of the present invention, the hollow body has a first necked-down portion, the circuit board has a second necked-down portion, and the second necked-down portion leans against the first necked-down portion.

In an embodiment of the illuminating device of the present invention, the hollow body further has a pair of tracks disposed therein near the first hooking portions, and the circuit board is inserted into the tracks.

In an embodiment of the illuminating device of the present invention, a heat sink disposed on the second opening end is further comprised.

In an embodiment of the illuminating device of the present invention, a lamp shade combined with the heat sink is further comprised, wherein the heat sink is located between the lamp shade and the hollow body.

In an embodiment of the illuminating device of the present invention, a threaded base engaging with the first opening end of the hollow body is further comprised.

In an embodiment of the illuminating device of the present invention, a thermal compound filled inside the hollow body is further comprised.

Based on the above, in an illuminating device of the present invention, hooking portions contained in a hollow body are disposed on an end of the hollow body which engages with a threaded base. Therefore, the illuminating device has a structure different from that of conventional illuminating devices. By means of such disposition, an interior space of the hollow body is increased, such that size of a circuit board is increased. On the other hand, when a thermal compound is filled into the hollow body, since the hooking portions are located on a threaded portion of the hollow body which engages with the threaded base, wherein the threaded portion is covered by the threaded base, leakage of the paste is prevented.

In order to make the aforementioned and other features and advantages of the present invention comprehensible, an exemplary embodiment accompanied with figures are described in detail below.

DESCRIPTION OF THE EMBODIMENTS

Figure 1:
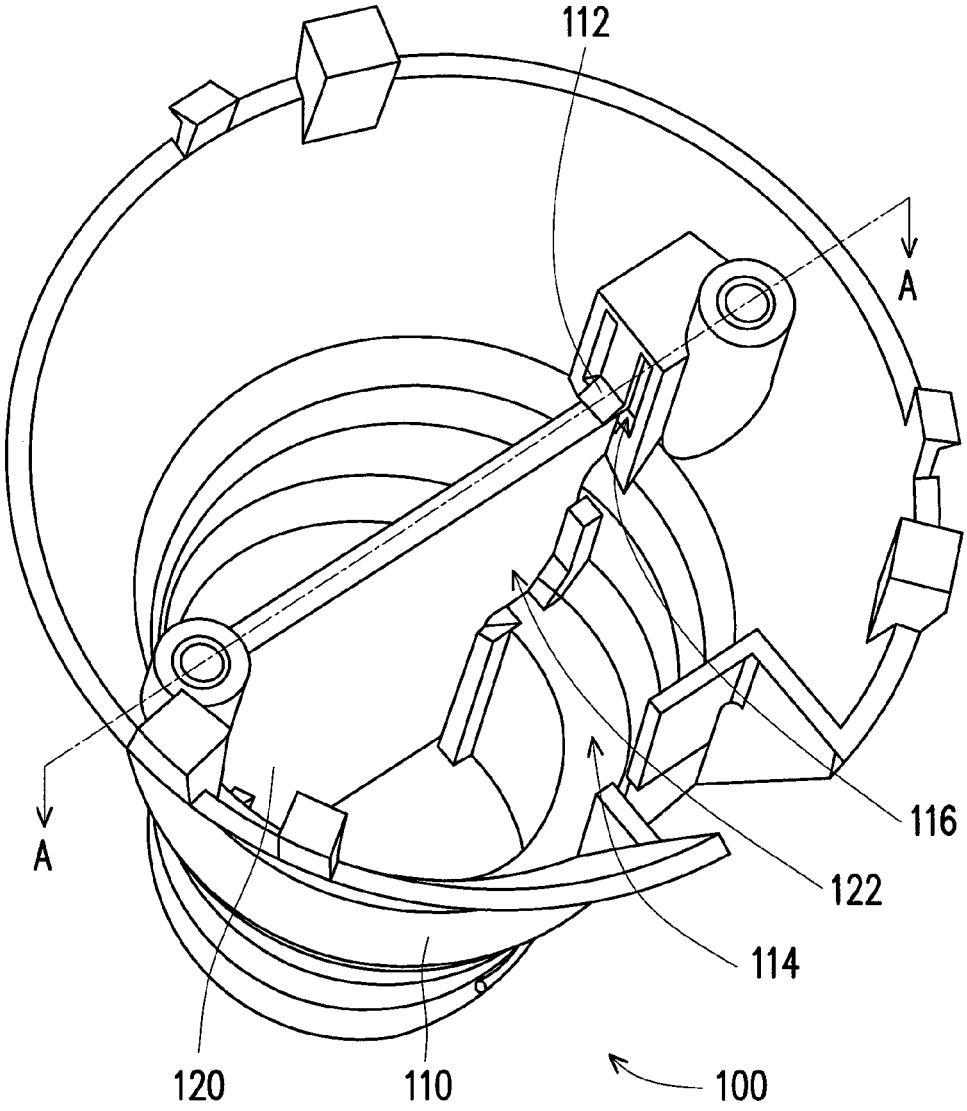
FIG. 1 (RELATED ART)
FIG. 1 is a partial three-dimensional schematic view of a conventional illuminating device which uses a light emitting diode as its light source.
Figure 2:
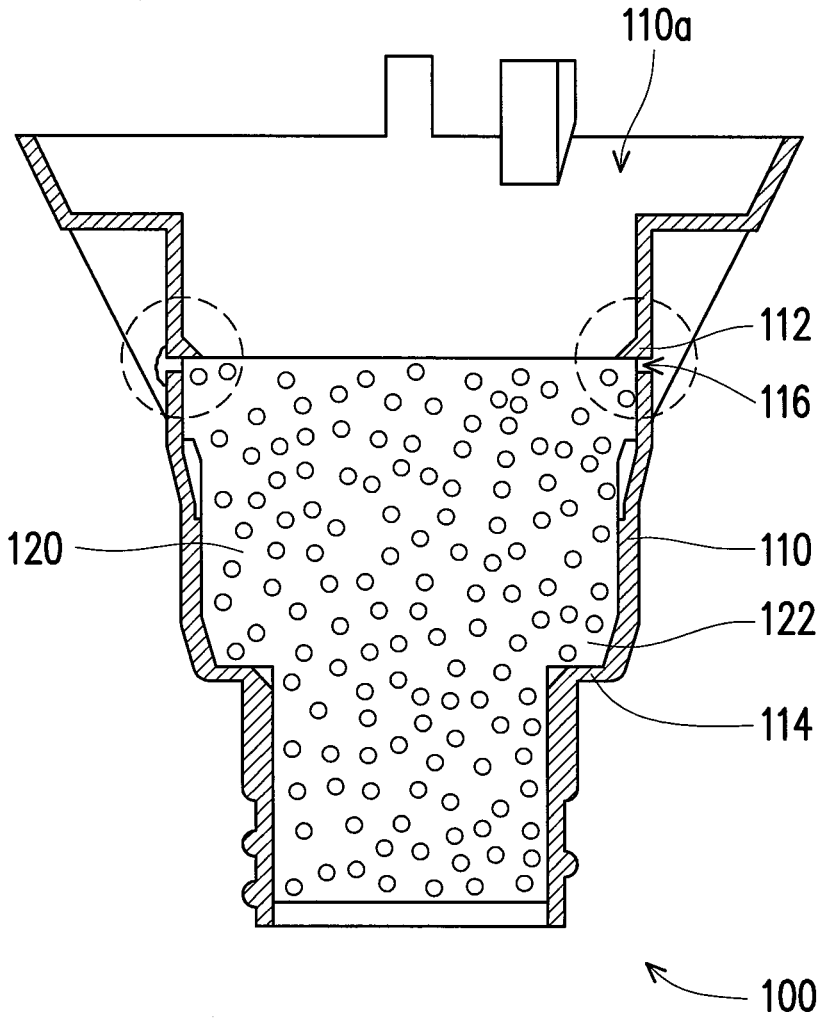
FIG. 2 (RELATED ART)
FIG. 2 is a cross-sectional schematic view along a section line A-A in FIG. 1.
Figure 3:
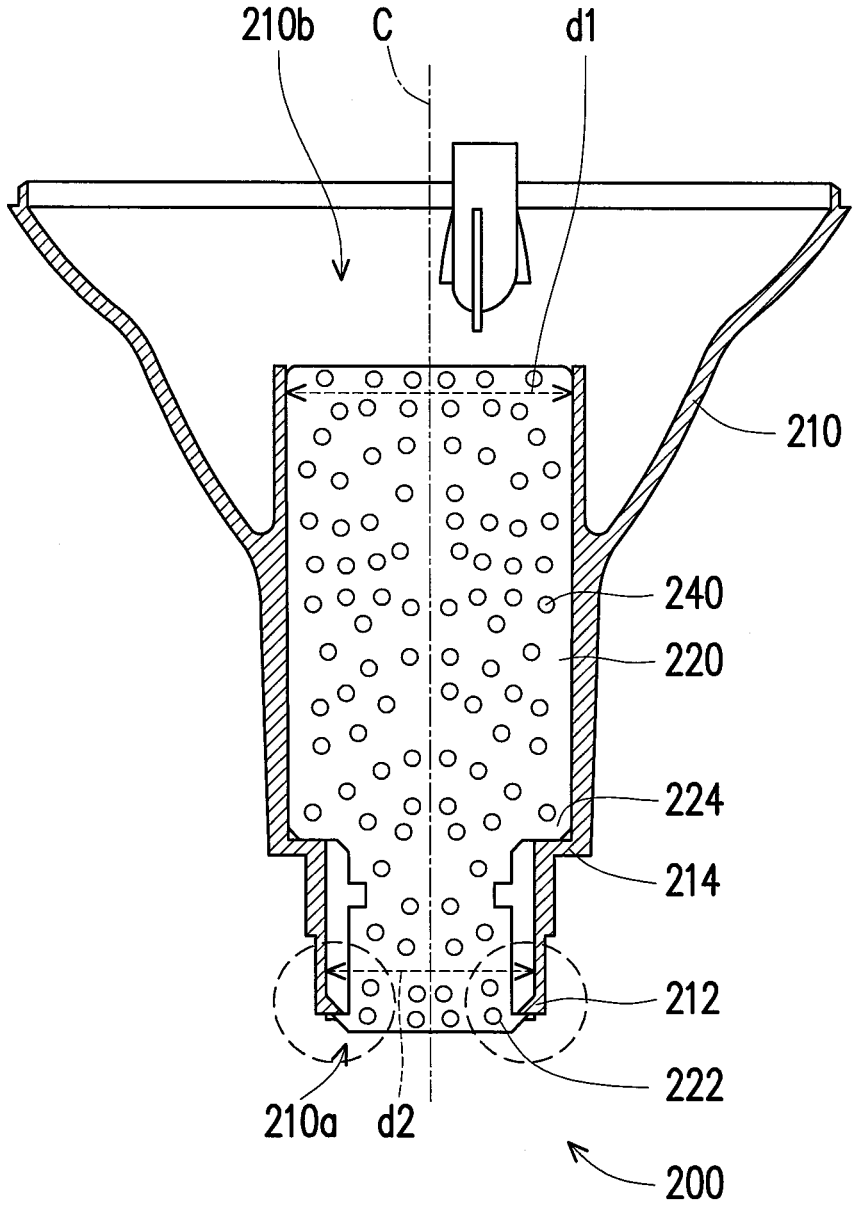
FIG. 3 is a cross-sectional schematic view of an illuminating device of an embodiment of the present invention.
Figure 4:
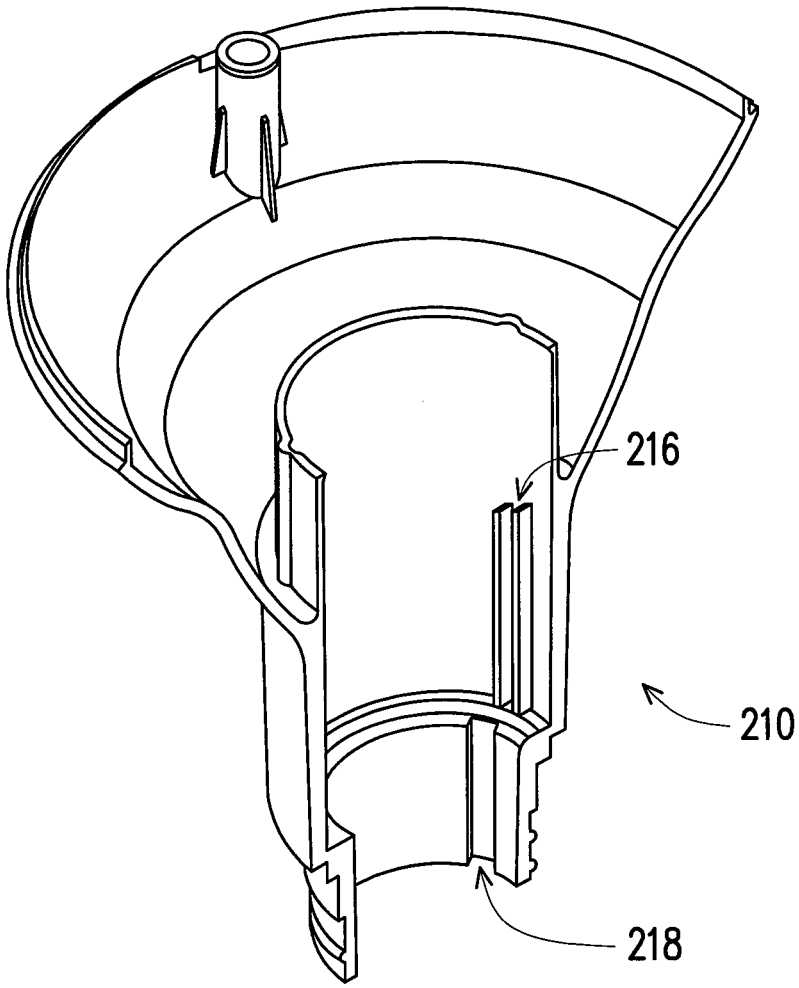
FIG. 4 is a cross-sectional view of the hollow body in FIG. 3.

FIG. 3 is a cross-sectional schematic view of an illuminating device of an embodiment of the present invention, and FIG. 4 is a cross-sectional view of the hollow body in FIG. 3. Referring to both FIG. 3 and FIG. 4, an illuminating device 200 of the present embodiment comprises a hollow body 210 and a circuit board 220, wherein the hollow body 210 has a first opening end 210*a*, a second opening end 210*b* and a pair of first hooking portions 212, wherein a bore d1 of the second opening end 210*b* is larger than a bore d2 of the first opening end 210*a*, and the first hooking portions 212 are disposed on the first opening end 210*a*. The circuit board 220 is disposed in the hollow body 210 and has a pair of second hooking portions 222. The first hooking portions 212 interfere with the second hooking portions 222.

Specifically, the first opening end 210*a* is a threaded portion, and the first hooking portions 212 are located on this threaded portion. The illuminating device 200 further comprises a threaded base 230 engaging with the first opening end 210*a* of the hollow body 210, wherein an inner diameter (not illustrated) of the threaded base 230 is slightly larger than an outer diameter (not illustrated) of the threaded portion, the threaded portion is screwed into the threaded base 230 and is tightly fitted, and the hollow body 210 and the threaded base 230 are assembled together.

In addition, the first hooking portions 212 are located at two ends of a diameter (not illustrated) of the first opening end 210*a*, and hooking directions of the first hooking portions 212 are toward the circuit board 220, i.e. toward an inner side of the hollow body 210; hooking directions of the second hooking portions 222 are toward the hollow body 210, i.e. hooking directions of the second hooking portions 222 are toward an outer side of the circuit board 220. When the circuit board 220 is assembled inside the hollow body 210, the second hooking portions 222 pass through the first opening end 210*a* to be located outside the hollow body 210. In the present embodiment, the first hooking portions 212 are formed by hollowing out a portion of a side wall of the hollow body 210, from an edge of the first opening end 210*a* of the hollow body 210, along an axial direction of the hollow body 210 and toward the second opening end 210*b*. In other words, the first hooking portions 212 are elastic-arm latch hooks.

Following the above, the hollow body 210 has a first necked-down portion 214, and the circuit board 220 has a second necked-down portion 224. When the circuit board 220 is assembled inside the hollow body 210, the second necked-down portion 224 leans more against the first necked-down portion 214. In addition, for convenience of assembly of the circuit board 220 and the hollow body 210, the hollow body 210 further has a pair of tracks 216, which is disposed in the hollow body 210 and near the first hooking portions 212. The circuit board 220 is inserted into the tracks 216. The tracks 216 also fix relative positions of the circuit board 220 and the hollow body 210, preventing the circuit board 220 from rotating in the hollow body 210 by using a central axis C of the hollow body 210 as an axle center.

When the circuit board 220 is assembled to the hollow body 210, an end of the circuit board 220 which has the second hooking portions 222 is toward the hollow body 210, and the circuit board 220 is disposed into the tracks 216 of the hollow body 210 from the second opening end 210*b* of the hollow body 210 and along the axial direction of the hollow body 210. Since the hooking directions of the first hooking portions 212 and the hooking directions of the second hooking portions 222 are opposite, the first hooking portions 212 of the hollow body 210 and the second hooking portions 222 of the circuit board 220 interfere with each other to be hooked together, so as to restrict the circuit board 220 from relatively moving along the axial direction of the hollow body 210. In addition, disposition of the tracks 216 restricts the circuit board 220 from rotating relative to the hollow body 210, and the second necked-down portion 224 of the circuit board 220 leans more against the first necked-down portion 214 of the hollow body 210.

By disposing the first hooking portions 212 on the first opening end 210*a*, space at the second opening end 210*b* becomes available, thus increasing selectability in size of the circuit board 220. Simply speaking, the relative width or length of the circuit board 220 at the second opening end 210*b* may be increased, and more allowance is provided for adjustment of the electronic elements disposed on the circuit board 220.

In addition, the illuminating device 200 further comprises a thermal compound 240 filled inside the hollow body 210, wherein the thermal compound 240 is filled between the hollow body 210 and the circuit board 220 after the relative positions of the circuit board 220 and the hollow body 210 are fixed, so as to improve heat sink efficiency of the electronic elements on the circuit board 220. The first hooking portions 212 are located on the first opening end 210*a* of the threaded portion, and the threaded base 230 is assembled to an outer side of the first opening end 210*a* by being screwed with the threaded portion; in other words, the threaded base 230 covers a hollowed-out portion 218 of the hollow body 210. Therefore, when the thermal compound 240 is filled into the hollow body 210, leakage of the thermal compound 240 is prevented.

Another thing to be noted is that since the hollowed-out portion 218 of the hollow body 210 is covered by the threaded base 230, the outside exposed part of the hollow body 210 is presented in a complete appearance without any hole visible. Therefore, the hollow body 210 directly works as an appearance element; in other words, there is no need to cover the outside of the hollow body 210 with another element.

Figure 5:
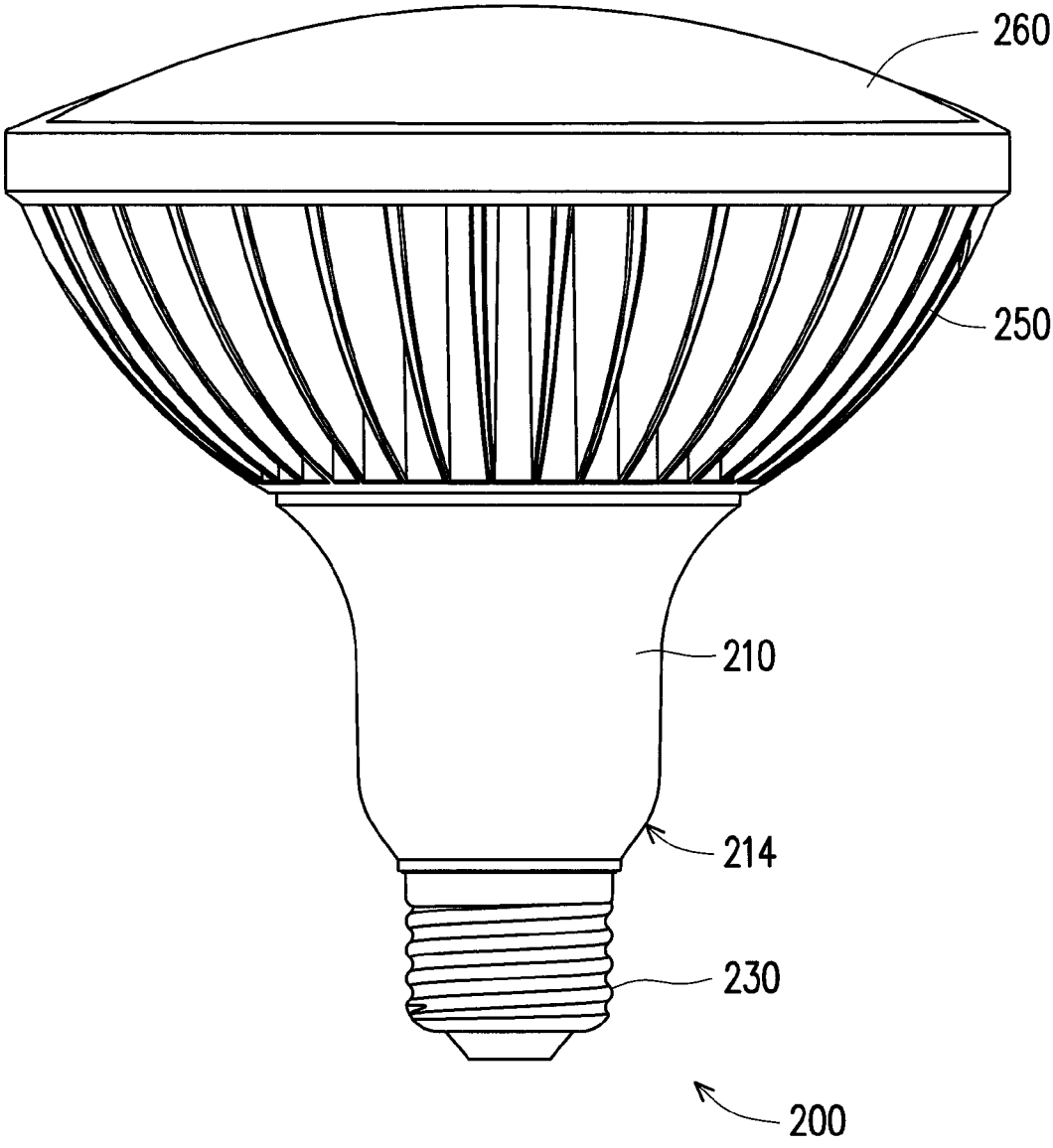
FIG. 5 is a schematic view of assembly of the illuminating device.

FIG. 5 is a schematic view of assembly of the illuminating device. Referring to FIG. 5, the illuminating device 200 further comprises a heat sink 250 disposed on the second opening end 210*b* and a lamp shade 260 combined with the heat sink 250, wherein the heat sink 250 is located between the lamp shade 260 and the hollow body 210. Of course, the illuminating device 200 further comprises other members such as at least one light emitting diode (not illustrated) as a light source, a lens covering a top of the light emitting diode, and a thermal pad. These elements are optional for use for persons of ordinary skill in the art according to their needs, and therefore explanations thereof are omitted.

In summary, in an illuminating device of the present invention, hooking portions contained in a hollow body are disposed on an end of the hollow body which engages with a threaded base. Therefore, the illuminating device has a structure different from that of conventional illuminating devices. By means of such disposition, an interior space of the hollow body is increased, such that size of a circuit board is increased, and disposition allowance for electronic elements on the circuit board is increased as well.

On the other hand, when a thermal compound is filled into the hollow body, since the hooking portions are located on a threaded portion of the hollow body which engages with the threaded base, wherein the threaded portion is covered by the threaded base from outward, leakage of the thermal compound is prevented. Not only cost of material is reduced, assembling personnel also keep their hands clean.

Though the present invention has been disclosed above by the embodiment, it is not intended to limit the present invention. It will be apparent to persons of ordinary skill in the art that modifications and variations to the described embodiments may be made without departing from the spirit and scope of the present invention. Therefore, the protecting range of the present invention falls in the appended claims.

What is claimed is:

1. An illuminating device comprising:

a hollow body, having a first opening end, a second opening end and a pair of first hooking portions, wherein a bore of the second opening end is larger than a bore of the first opening end, and the pair of first hooking portions are disposed on the first opening end; and a circuit board, disposed in the hollow body and having a pair of second hooking portions, wherein the pair of first hooking portions interfere with the pair of second hooking portions.

2. The illuminating device as claimed in claim 1, wherein the first opening end is a threaded portion.

3. The illuminating device as claimed in claim 1, wherein the pair of first hooking portions is located at two ends of a diameter of the first opening end.

4. The illuminating device as claimed in claim 1, wherein hooking directions of the pair of first hooking portions are toward the circuit board.

5. The illuminating device as claimed in claim 4, wherein the pair of second hooking portions is located outside the hollow body, with its hooking directions being toward the hollow body.

6. The illuminating device as claimed in claim 1, wherein the pair of first hooking portions is formed by hollowing out a portion of a side wall of the hollow body.

7. The illuminating device as claimed in claim 1, wherein the hollow body has a first necked-down portion, the circuit board has a second necked-down portion, and the second necked-down portion leans against the first necked-down portion.

8. The illuminating device as claimed in claim 1, wherein the hollow body further has a pair of tracks disposed therein near the pair of first hooking portions, and the circuit board is inserted into the pair of tracks.

9. The illuminating device as claimed in claim 1, further comprising a heat sink disposed on the second opening end.

10. The illuminating device as claimed in claim 9, further comprising a lamp shade combined with the heat sink, wherein the heat sink is located between the lamp shade and the hollow body.

11. The illuminating device as claimed in claim 1, further comprising a threaded base engaging with the first opening end of the hollow body.

12. The illuminating device as claimed in claim 1, further comprising a thermal compound filled inside the hollow body.

* * * * *

UNITED STATES PATENT AND TRADEMARK OFFICE

CERTIFICATE OF CORRECTION

PATENT NO. : 8,789,979 B2
APPLICATION NO. : 13/736973
DATED : July 29, 2014
INVENTOR(S) : Hsien-Chang Wu It is certified that error appears in the above-identified patent and that said Letters Patent is hereby corrected as shown below:

On the title page, the item (30) Foreign Priority Application Data should read

--November 29, 2011 (CN).....201110386852.5, and May 16, 2012 (TW).....101117448--.

Signed and Sealed this
Twenty-second Day of December, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,789,979 B2
APPLICATION NO. : 13/736973
DATED : July 29, 2014
INVENTOR(S) : Hsien-Chang Wu It is certified that error appears in the above-identified patent and that said Letters Patent is hereby corrected as shown below:

On the title page, add the item (30) Foreign Priority Application Data

--November 29, 2011 (CN).....201110386852.5, and May 16, 2012 (TW).....101117448--.

This certificate supersedes the Certificate of Correction issued December 22, 2015.

Signed and Sealed this
Twenty-sixth Day of April, 2016

Michelle K. Lee

Michelle K. Lee
*Director of the United States Patent and Trademark Office*